US007953345B2

(12) United States Patent
Shimizu

(10) Patent No.: US 7,953,345 B2
(45) Date of Patent: May 31, 2011

(54) IMAGE FORMING DEVICE FACILITATING REPLACEMENT OF BELT UNIT

(75) Inventor: Takashi Shimizu, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 12/692,258

(22) Filed: Jan. 22, 2010

(65) Prior Publication Data

US 2010/0196046 A1 Aug. 5, 2010

(30) Foreign Application Priority Data

Jan. 30, 2009 (JP) ..... 2009-020958

(51) Int. Cl.
*G03G 15/00* (2006.01)

(52) U.S. Cl. ..... 399/110; 399/114

(58) Field of Classification Search ..... 399/107, 399/110–114, 121, 297, 299, 302, 308
See application file for complete search history.

(56) References Cited

U.S. PATENT DOCUMENTS 6,708,011 B2 * 3/2004 Nomura et al. ..... 399/110
6,731,895 B2 * 5/2004 Hamada et al. ..... 399/121
7,298,991 B2 * 11/2007 Kimura et al. ..... 399/117
2006/0140668 A1 6/2006 Sato et al.
2007/0048005 A1 3/2007 Nakano et al.

FOREIGN PATENT DOCUMENTS

JP 2006-184554 7/2006
JP 2007-047953 2/2007
JP 2007-057953 3/2007

* cited by examiner

*Primary Examiner* — Hoan Tran
(74) *Attorney, Agent, or Firm* — Banner & Witcoff, Ltd.

(57) ABSTRACT

An image forming device includes, a main casing, a drawer unit, and a transfer unit. The main casing has a first frame formed with a first opening and a second frame formed with a second opening. The main casing has a first inner space in communication with the first opening and the second opening. The drawer unit is movable between a first position and a second position. The drawer unit is accommodated in the first inner space when the drawer unit is in the first position. The drawer unit is partially drawn out from the first inner space through the first opening when the drawer unit is in the second position. When the drawer unit is moved to the second position, a mounting space is formed for allowing the first transfer unit to be mounted in the second inner space.

8 Claims, 6 Drawing Sheets

IMAGE FORMING DEVICE FACILITATING REPLACEMENT OF BELT UNIT

CROSS REFERENCE TO RELATED APPLICATION

This application claims priority from Japanese Patent Application No. 2009-020958 filed Jan. 30, 2009. The entire content of the priority application is incorporated herein by reference.

TECHNICAL FIELD

The present invention relates to an image forming device, such as a color printer.

BACKGROUND

There has been known a tandem type electrophotographic color printer. The printer includes an image forming unit that is mounted in and dismounted from a main casing when a cover is open. Typically, four photosensitive drums and four developing rollers are mounted on the image forming unit. The four developing rollers are in slidable contact with the four photosensitive drums respectively. With the four photosensitive drums and four developing rollers, yellow, cyan, magenta and black toner images are formed individually on the four photosensitive drums.

The image forming unit further includes a belt unit disposed below the image forming unit. The belt unit is configured from a pair of support rollers disposed in spaced-apart relation with each other, and an endless conveyor belt circularly movably supported between the support rollers. The belt unit is provided for conveying recording sheets of paper. In the structure of the color printer described above, the image forming unit disposed in the main casing bothers dismounting the belt unit from the main casing. That is, the belt unit cannot be dismounted from the main casing until the image forming unit is dismounted therefrom. An opening is formed in the main casing through which the image forming unit and the belt unit is mounted or dismounted.

In the color printer described above, an electrostatic latent image is formed on each of the photosensitive drums and is developed by the relevant color toner supplied by the associated developing roller. The toner images formed on the respective photosensitive drums are sequentially transferred on a recording paper to overlap one on the other as the recording paper is conveyed by the conveyor belt, thereby forming a color image on the recording paper.

Another type of color printer employs a belt unit. This belt unit is, however, not used for conveying the recording paper but used as an intermediate transfer belt. The toner images formed on the photosensitive drums are once transferred on the intermediate transfer belt and then transferred on a recording paper from the intermediate transfer belt. An intermediate transfer roller is disposed at the side of the intermediate transfer belt to abut the surface of the intermediate transfer belt.

SUMMARY

In view of the foregoing, the present invention has been made to provide an improved structure of an image forming device while obviating the disadvantages involved in the conventional color printers.

According to one aspect, an image forming device in accordance with the invention facilitates replacement of the belt unit. In this respect, the firstly described conventional color printer is troublesome in dismounting the belt unit from the main casing, as the image forming unit is large in size and heavy in weight and such large and heavy unit needs to be dismounted from the main casing beforehand for replacing the belt unit. In the secondly described conventional color printer, the intermediate transfer roller bothers dismounting the belt unit from the main casing, thereby making it difficult to dismount the belt unit therefrom.

In accordance with the invention, an image forming device includes, a main casing, a drawer unit, a first transfer unit, a second transfer unit, and a fixing unit. The main casing has a first frame formed with a first opening and a second frame formed with a second opening. The second frame is disposed in opposition to the first frame. The main casing has a first inner space in communication with both the first opening and the second opening. A plurality of photosensitive members is mounted on the drawer unit. The drawer unit is movable between a first position and a second position. The drawer unit is accommodated in the first inner space when the drawer unit is in the first position. At least a part of the drawer unit is drawn out from the first inner space through the first opening when the drawer unit is in the second position. The first transfer unit is disposed in a second inner space of the main casing. The first transfer unit is in contact with the plurality of photosensitive members when the drawer unit is in the first position. The second transfer unit is in contact with the first transfer unit. The fixing unit is disposed in the main casing and above the second opening. When the drawer unit is moved to the second position, a mounting/dismounting space is formed for allowing the first transfer unit to be mounted in and dismounted from the second inner space of the main casing through the second opening.

BRIEF DESCRIPTION OF THE DRAWINGS

The particular features and advantages of the invention as well as other objects will become apparent from the following description taken in connection with the accompanying drawings, in which.

DETAILED DESCRIPTION

Figure 1:
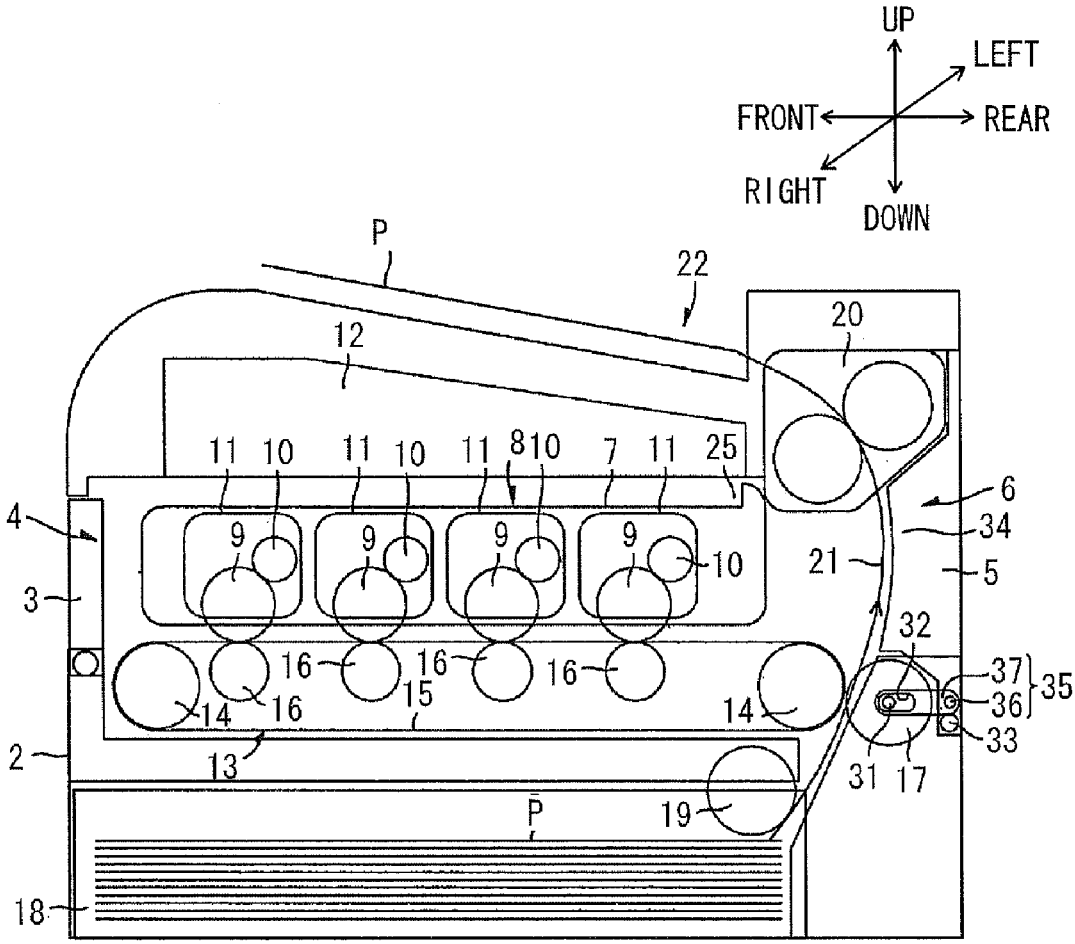
FIG. 1 is a schematic vertical cross-sectional view showing a color printer according to one embodiment of the invention, in which a drawer unit is disposed in a main casing.

A color printer according to an embodiment of the invention will be described while referring to the accompanying drawings wherein like parts and components are designated by the same reference numerals to avoid duplicating description. The color printer will be described as one example of an image forming device to which the invention pertains.

In the following description, orientations are referred to assuming that the color printer is disposed in an orientation in which it is intended to be used. Specifically, the left side of the color printer in FIGS. 1, 2, 4 and 5 will be referred to as the "front side", and the right side thereof as the "rear side". Also, the near side in FIGS. 1, 2, 4 and 5 will be referred to as the "right side" and the far side as the "left side". The left-to-right direction will be referred to as the "widthwise direction".

The color printer 1 in accordance with the embodiment of the invention is of a tandem and an intermediate transfer type, in which a plurality of image forming units (four in this embodiment) is arranged side-by-side and an intermediate transfer belt is used to separately receive yellow, cyan, magenta and black toner images from the image forming units and sequentially transfer the toner images on a recording paper so as to be overlapped one on the other, thereby forming a color image on the recording paper.

Figure 2:
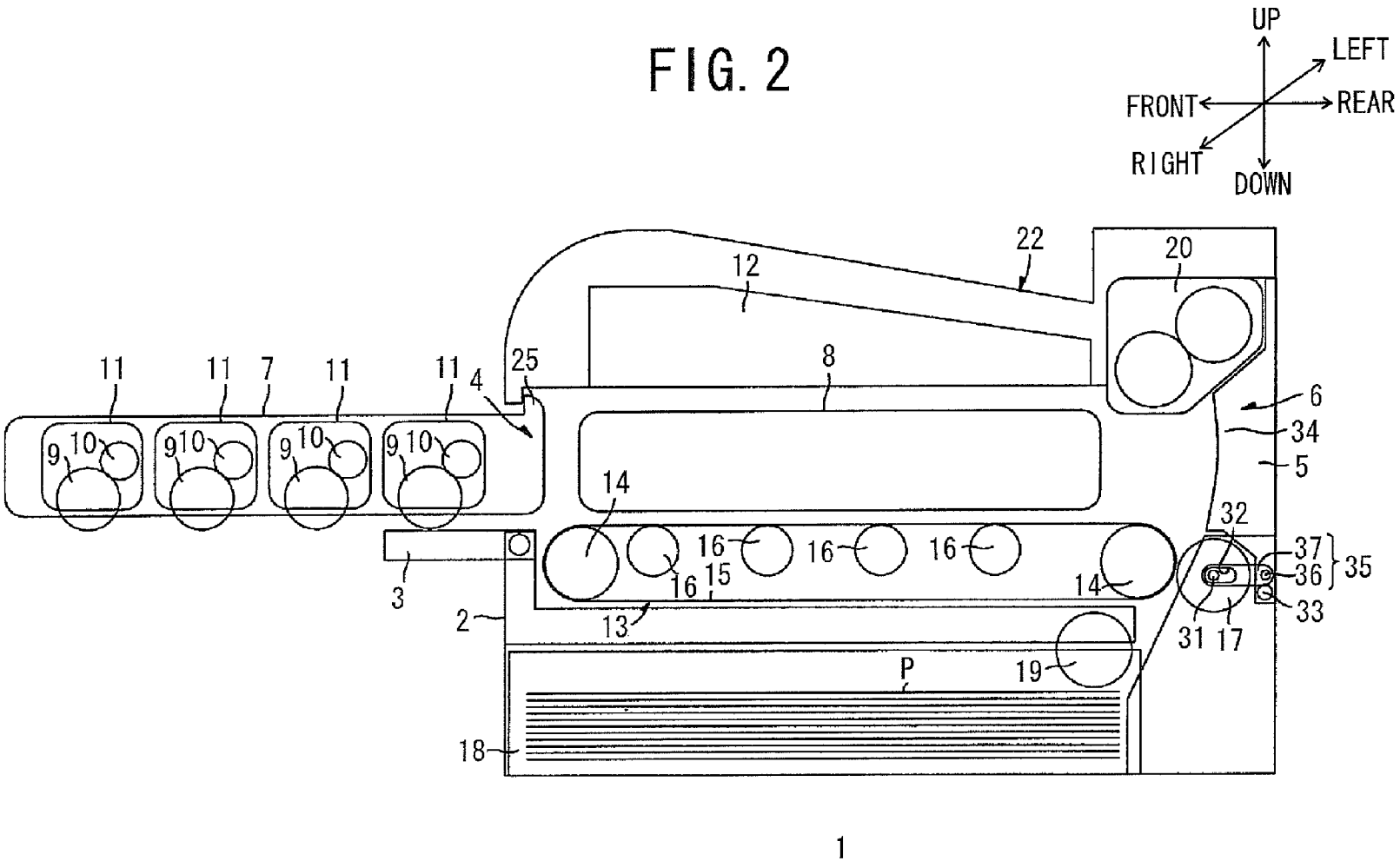
FIG. 2 is a schematic vertical cross-sectional view showing the color printer, in which the drawer unit is drawn out from the main casing.

The color printer 1 includes a main casing 2. The main casing 2 has a front frame to which a front cover 3 is hinged. As shown in FIG. 2, when the front cover 3 is open, a front opening 4 formed in the front frame of the main casing 2 is exposed. Also, the main casing 2 has a rear frame to which a rear cover 5 is hinged. When the rear cover 5 is open, a rear opening 6 formed in the rear frame of the main casing 2 is exposed.

The color printer 1 also includes a drawer unit 7 on which four process cartridges 11 are detachably mounted. Each process cartridge 11 includes a photosensitive drum 9 and a developing roller 10. The photosensitive drums 9 are disposed in the drawer unit 7 so that their peripheral surfaces are partially protruded from the bottom of the drawer unit 9. The developing roller 10 is in slidable contact with the peripheral surface of the photosensitive drum 9.

FIG. 1 shows a state in which the drawer unit 7 is retracted and disposed in a unit accommodating space 8 (first inner space) of the main casing 2. This retracted position will be referred to as a "first position". FIG. 2 shows a state in which the drawer unit 7 is drawn out from the unit receiving space 8 but is still held at the front side of the main casing 2. This drawn-out position will be referred to as a "second position".

The peripheral surface of the photosensitive drum 9 is uniformly charged by a charger (not shown) and then exposed to light by an exposure unit 12 disposed above the unit accommodating space 8. An electrostatic latent image is formed on the peripheral surface of the photosensitive drum 9 in accordance with image data. Each of the four process cartridges 11 has a toner-accommodating chamber. Yellow, cyan, magenta and black toner are separately accommodated in the four toner-accommodating chambers. The toner in the toner-accommodating chamber is supplied to the corresponding developing roller 10. The toner supplied to the developing roller 10 is regulated by a layer thickness regulating blade (not shown) to have a predetermined toner layer thickness. When the electrostatic latent image is brought into contact with the toner layer on the developing roller 10, the latent image is developed to a visible toner image.

A belt unit 13 is disposed in a space 80 (second inner space) below the unit accommodating space 8. The belt unit 13 includes a pair of support rollers 14 rotatably disposed in spaced-apart relation in the front-to-rear direction, an endless intermediate transfer belt 15 circularly movably supported between the support rollers 14, and four primary transfer rollers 16 disposed in opposition to the corresponding photosensitive drums 9. A secondary transfer roller 17 is rotatably disposed at the rear side of the color printer 1.

The intermediate transfer belt 15 has an upper part in sliding contact with the photosensitive drums 9. Each of the four primary transfer rollers 16 is disposed in opposition to the corresponding photosensitive drum 9 with the upper part of the intermediate transfer belt 15 interposed therebetween. The secondary transfer roller 17 is rotatably disposed at the rear side of the intermediate transfer belt 15 and is in pressure contact with the intermediate transfer belt 15 to nip a recording paper therebetween.

As the photosensitive drums 9 rotate and the intermediate transfer belt 15 circulates, the toner images formed on the photosensitive drums 9 are sequentially transferred to the intermediate transfer belt 15 so as to be overlapped one on the other.

A paper cassette 18 is disposed at the bottom of the main casing 2. A plurality of sheets of recording paper P is stacked in the paper cassette 18. The uppermost recording paper P is picked up by a pickup roller 19 and is fed into a nip between the intermediate transfer belt 15 and the secondary transfer roller 17. As the intermediate transfer belt 15 circulates, the toner image thereon is brought to the nip position and is transferred to the recoding paper P by virtue of the bias applied to the secondary transfer roller 17.

A fixing unit 20 is disposed above the secondary transfer roller 17 and at a higher position than the upper periphery of the rear opening 6. The recording paper P on which the toner image is transferred is further conveyed toward the fixing unit 20 along a sheet conveying path 21. The toner image on the recording paper P is pressed and heated to fix the toner image on the recording paper P. The recording paper P with the toner image fixed thereon is discharged onto a discharge tray 22 formed on the upper portion of the main casing 2.

The drawer unit 7 is movable between the first position and the second position. When the drawer unit 7 is in the first position as shown in FIG. 1, the same is retracted in the unit accommodating space 8. On the other hand, when the drawer unit 7 is in the second position as shown in FIG. 2, the drawer unit 7 is drawn out from the main casing 2.

The vertical cross-sectional shape of the drawer unit 7 taken along the widthwise direction is smaller than the front opening 4, and particularly the height of the drawer unit 7 is smaller than the vertical length of the front opening 4, thereby allowing the drawer unit 7 to be pulled out from the front opening 4. However, the height of the rear wall of the drawer unit 7 is larger than the vertical length of the front opening 4. Specifically, an upwardly extending stop 25 is formed at the upper rear end of the drawer unit 7. Thus, the height of the rear end of the drawer unit 7 is larger than the vertical length of the front opening 4. The stop 25 is brought in abutment with the inner surface of the front frame of the main casing 2 when the drawer unit 7 is fully drawn out from the front opening 4 as shown in FIG. 2. The stop 25 prevents the drawer unit 7 from being removed or separated from the main casing 2. When the drawer unit 7 is in the second position as shown in FIG. 2, replacement of the process cartridge 11 can be performed by dismounting a used cartridge and mounting a new cartridge in place of the used one.

Figure 3:
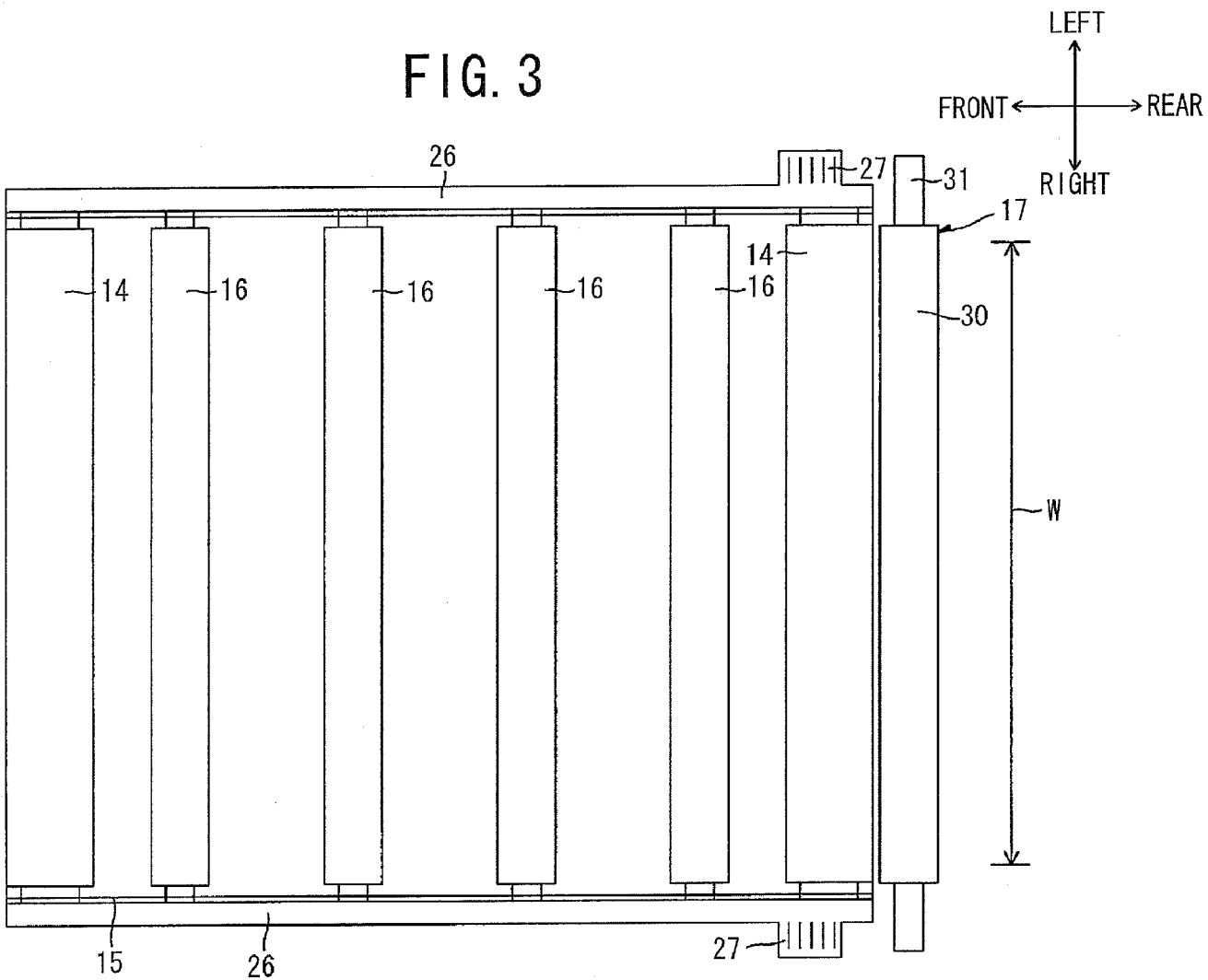
FIG. 3 is a plan view showing a belt unit and a secondary transfer roller used in the color printer shown in FIGS. 1 and 2.

In FIG. 3, the intermediate transfer belt 15 is depicted transparent in order to show the pair of support rollers 14 and four primary transfer rollers 16 sandwiched between the upper and lower parts of the endless transfer belt 15.

In addition to the pair of support rollers 14, the intermediate transfer belt 15, and the four primary transfer rollers 16, the belt unit 13 further includes a pair of side plates 26 and a pair of grip portions 27. The support rollers 14 are rotatably disposed one at the frontmost position of the belt unit 13 and the other at the rearmost position thereof The four primary transfer rollers 16 are disposed between the two support rollers 14 in spaced-apart relation to one another. The primary transfer rollers 16 are rotatably supported between the side plates 26. The grip portion 27 is a plate-shaped member formed at the rear portion of each side plate 26 to protrude outward. A number of grooves is formed at the upper and lower surfaces of the grip portion 27 to prevent slippage when the user grasps the grip portions 27.

As shown in FIGS. 1 and 2, the secondary transfer roller 17 is disposed at the rear side of the belt unit 13. The vertical position of the roller 17 is lower than the lower periphery of the rear opening 6. As shown in FIG. 3, the secondary transfer roller 17 is made up of a roller portion 30 and a roller shaft 31 in coaxial with each other. The roller portion 30 is in pressure contact with the rearmost part of the intermediate transfer belt 15. The diameter of the roller shaft 31 is smaller than that of the roller portion 30. The roller shaft 31 extends in the widthwise direction from both ends of the roller portion 30. The axial length of the roller portion 30, i.e., left-to-right directional width of the roller portion 30, is longer than the width W of the sheet conveying path 21. As shown in FIG. 2, each of the left and right frames of the main casing 2 is formed with an elongated hole 32 into which the roller shaft 31 is inserted.

Figure 4:
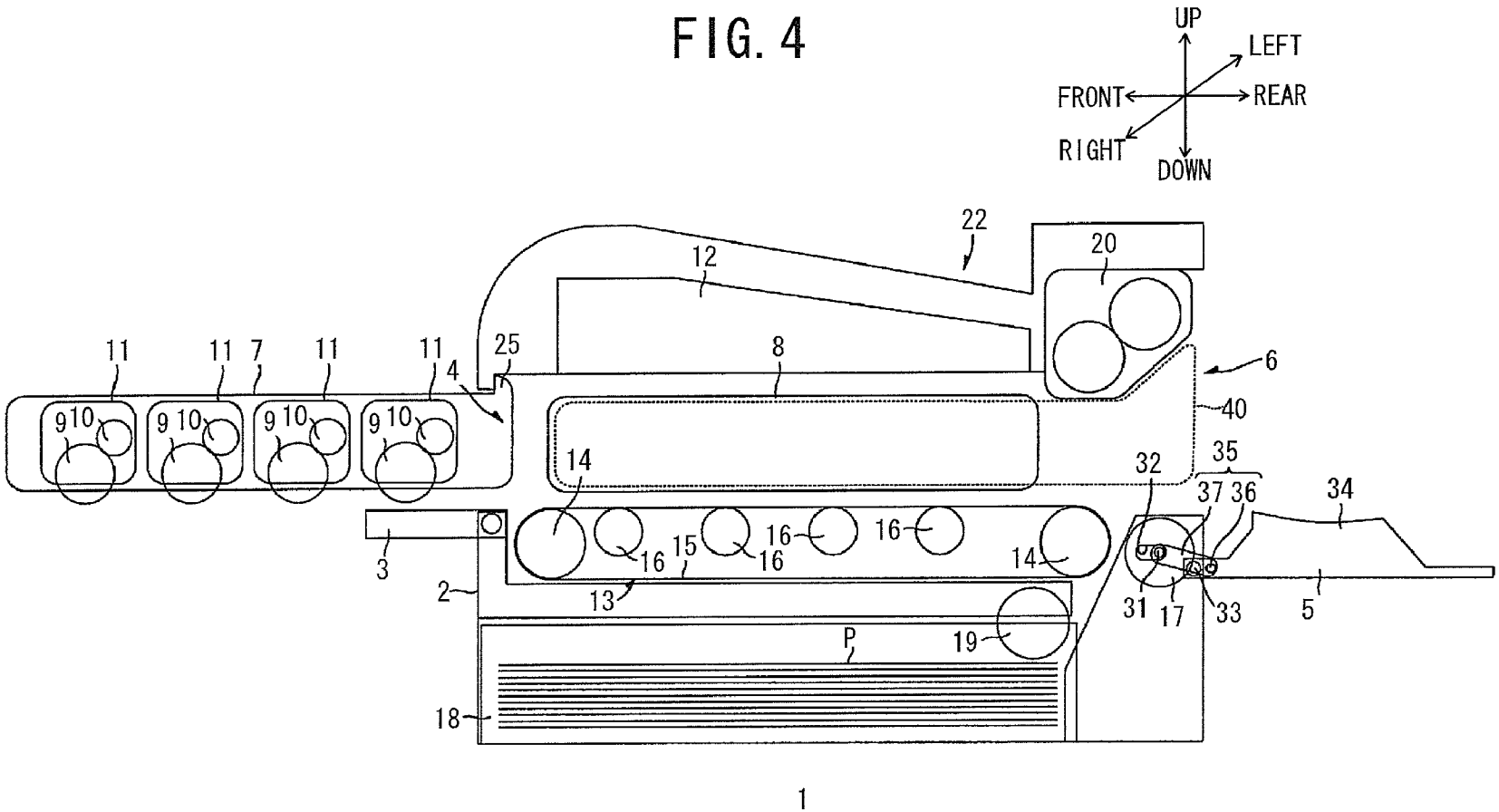
FIG. 4 is a schematic vertical cross-sectional view showing the color printer with a rear cover held open.

FIG. 4 shows the color printer 1 with the rear cover 5 held open. As shown in FIGS. 2 and 4, the rear cover 5 is pivotally movable about a rotation shaft 33. The rear opening 6 is covered with the rear cover 5 when the latter is closed. When the rear cover 5 is closed, its upper portion is brought into contact with the main casing 2. The rear cover 5 is brought to an open state by rotating it clockwise about rotation shaft 33 by about 90 degrees from the closed state. In the open state of the rear cover 5, the free end thereof is positioned at the rear side of the fixed end of the rear cover 5. In other words, the rear cover 5 is held substantially horizontally in the open state.

A guide 34 is formed in the inner surface of the rear cover 5. The guide 34 is of a generally trapezoidal shape when viewed from left or right. As shown in FIG. 1, the guide 34 has a guiding surface smoothly curved to follow the sheet conveying path 21. When the recording paper P is conveyed along the conveying path 21 and is brought into abutment with the guiding surface of the guide 34, the recording paper P is forced to move toward the fixing unit 20.

A separation mechanism 35 is provided between the rotation shaft 33 of the rear cover 5 and the roller shaft 31 of the secondary transfer roller 17. The separation mechanism 35 includes a link shaft 36 and a link lever 37.

As shown in FIG. 2, the link shaft 36 is disposed above the rotation shaft 33 of the rear cover 5 when the rear opening 6 is closed by the rear cover 5. The link shaft 36 is of a cylindrical shape and projects outward, i.e., leftward and rightward, from the lower portion of the rear cover 5. The link lever 37 is in the form of an elongated plate-shape when viewed from left-side or right-side. One end of the link lever 37 is coupled to the link shaft 36 to be rotatable relative to each other, and another end of the link lever 37 is coupled to the roller shaft 31 to be rotatable relative to each other.

When the rear cover 5 is closed to cover the rear opening 6, the roller shaft 31 of the secondary transfer roller 17 is positioned at the frontmost position of the elongated holes 32 formed in left and right frames of the main casing 2. The link shaft 36 is positioned above the rotation shaft 33 of the rear cover 5.

When the rear cover 5 is open to expose the rear opening 6, the link shaft 36 moves along the circumference of the rotation shaft 33 to be positioned behind or at the rear side of the rotation shaft 33. In accordance with the movement of the link shaft 36, the link lever 37 moves rearward. Accordingly, the roller shaft 31 coupled to the link lever 37 also moves rearward along the elongated hole 32.

When the rear cover 5 is brought to a complete open state, the link shaft 36 is disposed at the rear side position of the rotation shaft 33. The roller shaft 31 moves to the rearmost position of the elongated hole 32.

With such an arrangement, the secondary transfer roller 17 is moved rearward in conjunction with the opening operation of the rear cover 5, resulting in separation of the secondary transfer roller 17 from the intermediate transfer belt 15.

On the other hand, when the rear cover 5 is moved from the open position shown in FIG. 2 to the closed position shown in FIG. 1, the roller shaft 31 moves reversely. Hence, the secondary transfer roller 17 can be brought into contact with the intermediate transfer belt 15 in an interlocking manner with the closing operation of the rear cover 5.

Figure 5:
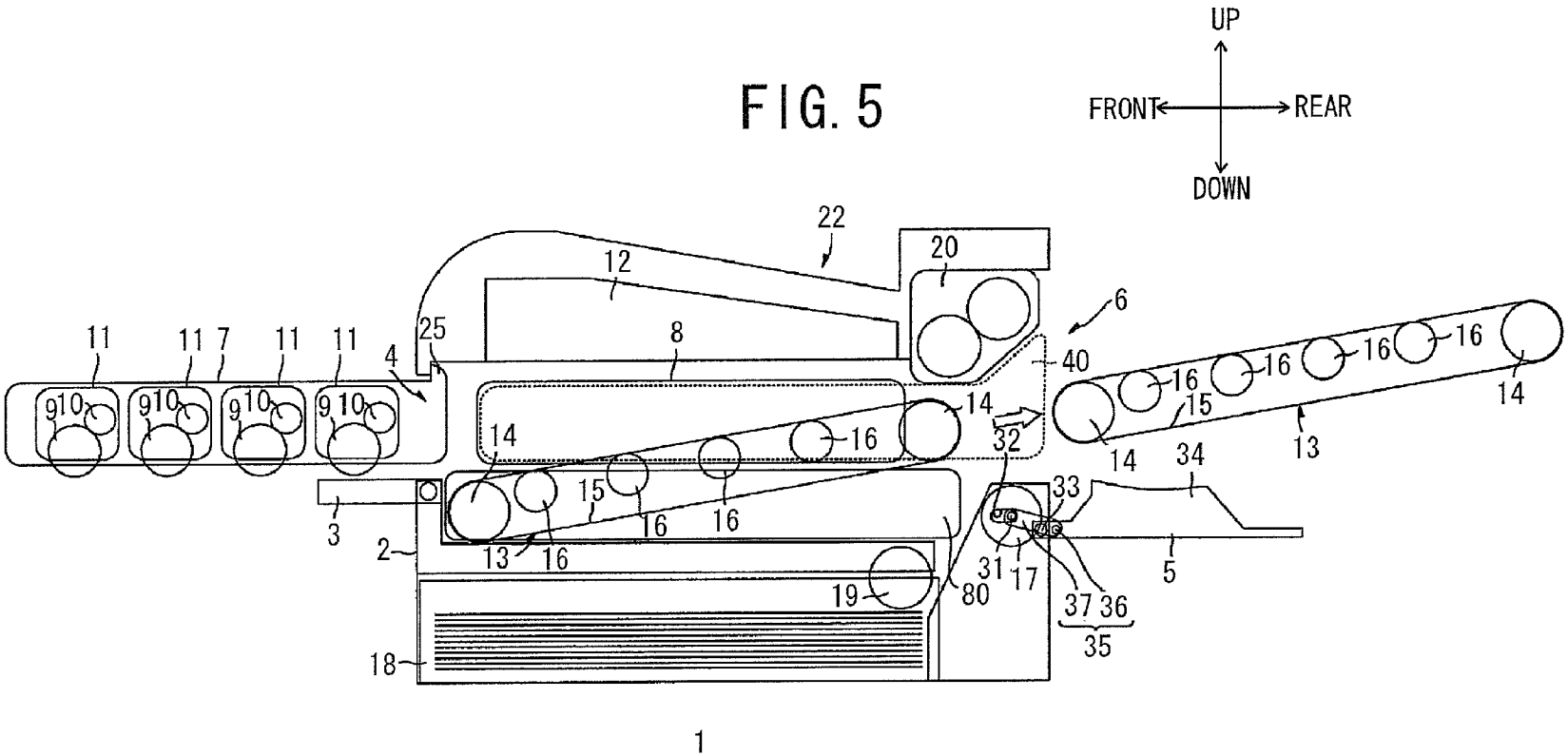
FIG. 5 is a schematic vertical cross-sectional view showing the color printer, in which the belt unit is about to be dismounted from the main casing.

FIG. 5 shows the color printer 1 showing the belt unit 13 being in the course of dismounting from the main casing 2. The belt unit 13 is capable of being dismounted from the main casing 2 when the drawer unit 7 is moved to the second position shown in FIG. 2 and the rear cover 5 is opened to expose the rear opening 6 as shown in FIG. 4. A mounting/dismounting channel 40 is formed in the main casing 2 for allowing the belt unit 13 to mount into and dismount from the main casing 2 through the rear opening 6. The channel 40 is shown by a dotted line in FIG. 4. Specifically, the channel 40 is formed in a part of the unit accommodating space 8 and also in the space between the secondary transfer roller 17 and the fixing device 20.

In order to dismount the belt unit 13 from the main casing 2, the user has to grasp the grip portions 27 and lift the rear portion of the belt unit 13 upward. After the rear portion of the belt unit 13 is lifted to a level of the rear opening 6, the belt unit 13 is drawn rearward. As shown in FIG. 5, the belt unit 13 can be removed from the main casing 2 through the rear opening 6, allowing the intermediate transfer belt 15 to replace with a new one. The belt unit 13 can be mounted in the main casing 2 through the reversed operations.

As described, the main casing 2 is formed with the unit accommodating space 8 in the interior thereof The front opening 4 and the rear opening 6 are formed in the front and rear frames of the main casing 2, respectively, so as to be in communication with the unit accommodating space 8. The main casing 2 is provided with the rear cover 5 for exposing and covering the rear opening 6. The drawer unit 7 is disposed in the interior of the main casing 2. The drawer unit 7 is movable between the first position and the second position. The first position is such a position where the drawer unit 7 is disposed in the interior of the main casing 2. When the drawer unit 7 is in the second position, at least a part of the drawer unit 7 protrudes out of the unit accommodating space 8 through the front opening 4. A plurality of photosensitive drums 9 is mounted in the drawer unit 7. When the drawer unit 7 is disposed in the first position, the intermediate transfer belt 15 is in contact with the respective photosensitive drums 9. The secondary transfer roller 17 is also in contact with the intermediate transfer belt 15 at a position downstream of the photosensitive drums 9. When the drawer unit 7 is disposed in the second position and the rear cover 5 is open, the channel 40 is formed by at least a part of the unit accommodating space 8 and the space between the secondary transfer roller 17 and the fixing unit 20. The channel 40 is in communication with the rear opening 6 and allows the intermediate transfer belt 15 to mount into and dismount from the main casing 2.

With the structure described above, the drawer unit 7 is firstly drawn to the second position to thereby form the channel 40. Then, the intermediate transfer belt 15 can be dismounted from the main casing 2 through the channel 40 without need for complete separation of the drawer unit 7 from the main casing 2.

The fixing unit 20 is disposed above the topmost portion of the rear opening 6. Therefore, the fixing unit 20 does not bother mounting/dismounting operation of the intermediate transfer belt 15. The separation mechanism 35 separates the secondary transfer roller 17 from the intermediate transfer belt 15 in an interlocking relation with the opening of the rear cover 5 and the separation is performed within the main casing 2. In order to dismount the intermediate transfer belt 15 from the main casing 2, the secondary transfer roller 17 needs to be separated from the intermediate transfer belt 15. Due to the provision of the separation mechanism 35, opening of the rear cover 5 automatically separates the secondary transfer roller 17 from the intermediate transfer belt 15. This lessens the load imposed upon the user for separating the intermediate transfer belt 15 from the main casing 2.

The grip portions 27 are formed to the side plates 26 of the intermediate transfer belt 15. The grip portions 27 facilitate the mounting/dismounting operation of the intermediate transfer belt 15. The grip portions 27 are formed at both sides of the belt unit 13. The grip portions 27 are formed in positions offset from the sheet conveying path 21, so that smooth conveyance of the recording paper P is ensured and easy mounting/dismounting of the intermediate transfer belt 15 can be accomplished.

The guide 34 is formed in the inner surface of the rear cover 5. The guide 34 serves to guide the recording paper P to be conveyed along the sheet conveying path 21 after passing through the nip between the intermediate transfer belt 15 and the secondary transfer roller 17. Opening the rear cover 5 widens the space between the intermediate transfer belt 15 and the secondary transfer roller 17. This facilitates the paper jam to resolve once it occurs on the sheet conveying path 21.

The lowermost portion of the rear opening 6 is above the uppermost peripheral portion of the secondary transfer roller 17. That is, the secondary transfer roller 17 is disposed so as not to narrow the rear opening 6. As such, the secondary transfer roller 17 is prevented from being touched by the user at the time of mounting/dismounting operation of the intermediate transfer belt 15.

While the invention has been described in detail with reference to the embodiment thereof, it would be apparent to those skilled in the art that various changes and modifications may be made therein without departing from the spirit of the invention.

Figure 6:
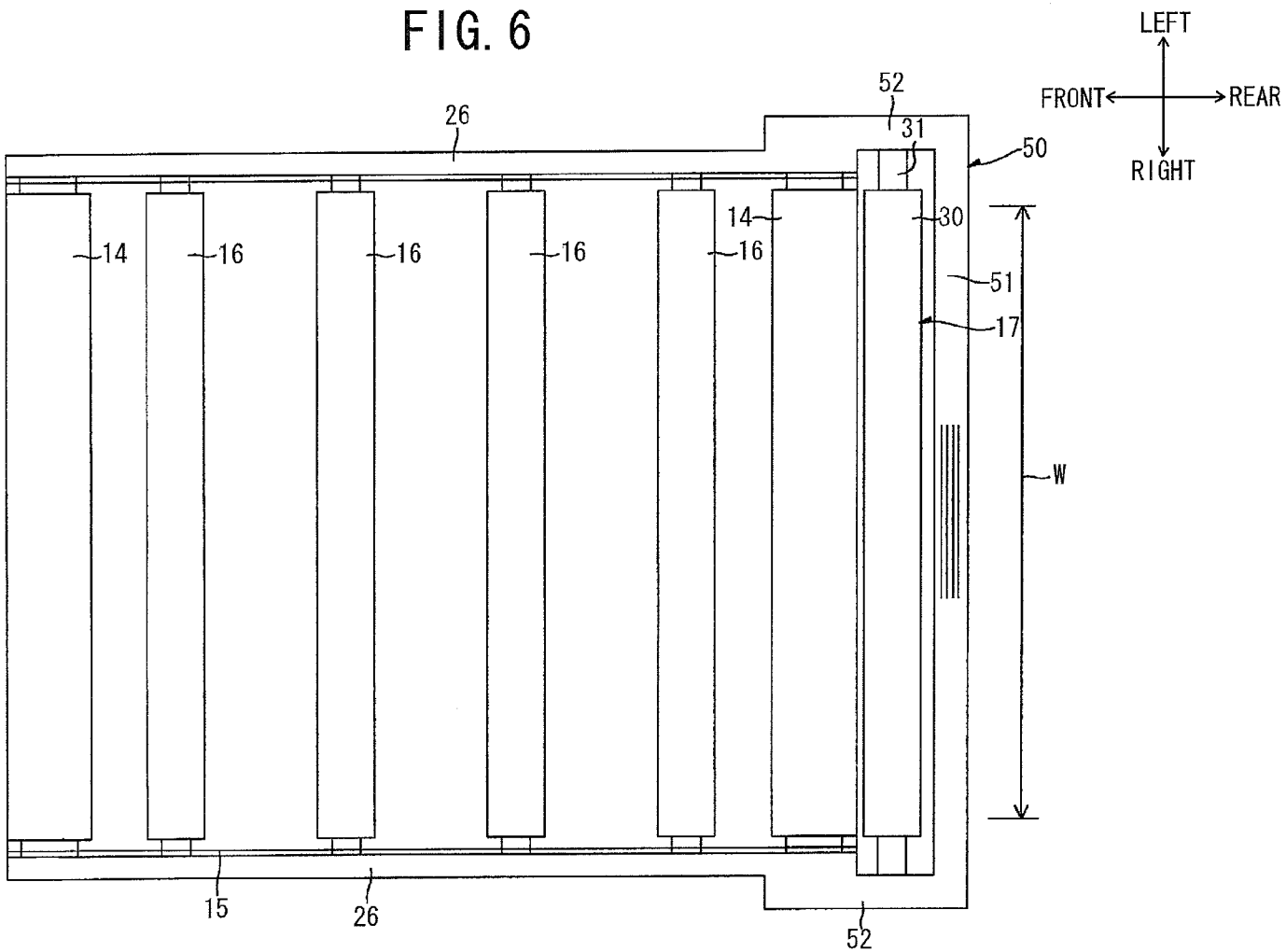
FIG. 6 is a plan view showing a belt unit according to another embodiment of the invention.

For example, as shown in FIG. 6, unlike the embodiment described above, a grip portion 50 may be formed to be of a generally U-shaped in plan view. The U-shaped grip portion 50 has two free ends secured to the rear portions of the side plates 26. More specifically, the grip portion 50 is configured from a main part 51 and left and right coupling parts 52. The main part 51 is disposed at the rear side of the secondary transfer roller 17 and extends in the widthwise or axial direction thereof with a spacing therebetween. The left and right coupling parts 52 are secured to both ends of the main part 51 and extend in the front-to-rear direction perpendicular to the axial direction of the secondary transfer roller 17. The left and right coupling parts 52 are also secured to the left and right side plates 26, respectively, so that the grip portion 50 and the side plates 26 are integral with each other.

The main part 51 has a width greater than the width W of the sheet conveying path 21. The front-side end of each coupling part 52 is secured to the rear end portion of the corresponding side plate 26. The roller portion 30 of the secondary transfer roller 17 is disposed between the two coupling parts 52 and the shaft 31 thereof is rotatably supported therebetween.

The various advantages described with regard to the embodiment shown in FIGS. 1 to 5 are also applicable to the modified structure of the belt unit as shown in FIG. 6. The belt unit may further be modified so that the grip portion 50 is formed to extend toward the rear opening 6 (see FIG. 4) from the belt unit 13. For example, each coupling part 52 may be slanted in such a manner that the rear end thereof is raised to be a higher position than the front end thereof. With such a structure, the main part 51 can be positioned more closely to the rear opening 6, and hence operation of the intermediate transfer belt 15 can be easily performed even if the intermediate transfer belt 15 is disposed in the lower portion of the main casing 2.

What is claimed is:

1. An image forming device comprising:

a main casing having a first frame formed with a first opening and a second frame formed with a second opening and disposed in opposition to the first frame, the main casing having a first inner space in communication with both the first opening and the second opening;

a drawer unit on which a plurality of photosensitive members is mounted, the drawer unit being movable between a first position and a second position wherein the drawer unit is accommodated in the first inner space when the drawer unit is in the first position and at least a part of the drawer unit is drawn out from the first inner space through the first opening when the drawer unit is in the second position;

a first transfer unit disposed in a second inner space of the main casing, the first transfer unit being in contact with the plurality of photosensitive members when the drawer unit is in the first position;

a second transfer unit in contact with the first transfer unit; and a fixing unit disposed in the main casing and above the second opening, wherein when the drawer unit is moved to the second position, a mounting/dismounting channel is formed for allowing the first transfer unit to be mounted in and dismounted from the second inner space of the main casing through the second opening, and the at least a part of the first inner space constitutes at least a part of the mounting/dismounting channel.

2. The image forming device according to claim 1, wherein the drawer unit is formed with a stop that is brought into abutment with the first frame when the drawer unit is moved to the second position.

3. The image forming device according to claim 1, further comprising:

a cover selectively exposing and covering the second opening; and a separation mechanism that separates the second transfer unit from the first transfer unit in an interlocking relation with the opening of the cover.

4. The image forming device according to claim 3, wherein the cover is formed with a guide for guiding a recording paper having passed through a nip between the first transfer unit and the second transfer unit toward the fixing unit.

5. The image forming device according to claim 1, further comprising a grip portion, wherein the first transfer unit has an end portion close to the second opening and remote from the first opening, the grip portion being formed in the end portion of the first transfer unit.

6. The image forming device according to claim 5, wherein the first transfer unit includes an endless belt disposed in opposition to the plurality of photosensitive members, a pair of support rollers disposed in a spaced-apart relation that circularly movably supports the endless belt, and a pair of frames that rotatably support the pair of support rollers therebetween, wherein the second transfer unit includes a transfer roller having a rotation axis extending in a predetermined direction, the grip portion being formed in each of the pair of the frames, at least a part of the grip portion protruding in the predetermined direction.

7. The image forming device according to claim 1, wherein the second transfer unit is disposed below the second opening.

8. The image forming device according to claim 1, wherein the second transfer unit is disposed in a position nearer to the second opening than the first opening.

* * * * *